United States Patent [19]

Fujiya

[11] Patent Number: 4,480,451

[45] Date of Patent: Nov. 6, 1984

[54] DOOR LOCK UNLOCKABLE FROM INDOOR SIDE

[76] Inventor: Toshimichi Fujiya, No. 4-22, Kounandai 6-chome, Kounan-ku, Yokohama-shi, Kanagawa-ken, Japan

[21] Appl. No.: 471,256

[22] Filed: Mar. 2, 1983

[51] Int. Cl.[3] ..... E05B 65/10; E05C 9/04

[52] U.S. Cl. ..... 70/92; 70/208; 292/21; 292/336.3; 292/DIG. 27

[58] Field of Search ..... 70/92, 208, 209, 210; 292/21, 92, DIG. 65, DIG. 27, 336.3

[56] References Cited

U.S. PATENT DOCUMENTS

| | | | |
|---|---|---|---|
| 2,239,301 | 4/1941 | Papst | 70/208 X |
| 2,246,708 | 6/1941 | Wieben | 70/208 |
| 2,599,054 | 6/1952 | Gates et al. | 70/208 |
| 3,044,287 | 7/1962 | Pelcin | 70/92 X |
| 3,745,796 | 7/1973 | Fleming | 70/208 X |
| 4,108,482 | 8/1978 | Dietrich et al. | 292/DIG. 27 X |

FOREIGN PATENT DOCUMENTS

| | | | |
|---|---|---|---|
| 613962 | 2/1961 | Canada | 70/92 |
| 541427 | 5/1924 | France | 70/210 |
| 993801 | 6/1965 | United Kingdom | 292/336.3 |
| 2084643 | 4/1982 | United Kingdom | 70/92 |

*Primary Examiner*—Gary L. Smith
*Assistant Examiner*—Russell W. Illich
*Attorney, Agent, or Firm*—Martin Smolowitz

[57] ABSTRACT

A door lock unlockable from the indoor side comprises a handle device and a lock device. The handle device includes an indoor handle and an outdoor handle for operating a latch means for a door panel to a stationary frame. The lock device is operated from the outdoor side so as to be brought into and out of engagement with said indoor handle thereby to lock said indoor handle and said outdoor handle against rotation. The indoor handle is pivotally supported so as to be able to be swung towards and away from said door panel and adapted to be disengaged from said lock device by a predetermined swinging toward or away from said door panel, the engaging structure between said indoor handle and said lock device being exposed on the inner surface of said door panel. The door lock permits an easy recognition and understanding of the way to manipulate the indoor unlocking mechanism, as well as a simple and easy manipulation, thereby to ensure a prompt escape from the chamber.

4 Claims, 6 Drawing Figures

DOOR LOCK UNLOCKABLE FROM INDOOR SIDE

BACKGROUND OF THE INVENTION

The present invention relates to a door lock unlockable from the indoor side and, more particularly, a door lock for use in walk-in type large-size refrigeration chambers or compartments for electric power boards or feeder panels, improved to eliminate any accidental confinement of workers in the refrigeration chamber or compartment due to a careless locking operation at the outdoor side.

Door locks unlockable from the indoor side have been known. In the conventional door locks of the kind described, however, the major part of the indoor unlocking mechanism is concealed in the casing and only the manipulation end of the mechanism appears on the inner surface of the door panel. Therefore, it is quite difficult, particularly for those who are not familiar with the internal structure of the lock to immediately understand how to manipulate the manipulation end of the unlocking mechanism. The worker who has been accidentally confined in a chamber or compartment is unable to easily and immediately understand how to unlock, he will gradually have the jitters which in turn makes it difficult to take a calm attitude toward the relief and, in the worst case, will be upset or beside himself and lose the chance of escape by himself.

SUMMARY OF THE INVENTION

Accordingly, an object of the invention is to provide a door lock which permits an easy recognition and understanding of the way to manipulate the indoor unlocking mechanism, as well as a simple and easy manipulation, thereby to ensure a prompt escape from the chamber or compartment.

To this end, according to the invention, there is provided a door lock unlockable from the indoor side comprising: a handle device including an indoor handle and an outdoor handle for operating a latch means for latching a door panel to a stationary frame; and a lock device adapted to be operated from the outdoor side so as to be brought into and out of engagement with the indoor handle, thereby to lock the indoor handle and the outdoor handle against rotation; the indoor handle being pivotally supported so as to be able to be swung towards and away from the door panel and adapted to be disengaged from the lock device by a predetermined swinging toward or away from the door panel, the engaging structure between the indoor handle and the lock device being exposed on the inner surface of the door panel.

These and other objects, features and advantages of the invention will become clear from the following description of the preferred embodiments taken in conjunction with the accompanying drawings.

DESCRIPTION OF THE PREFERRED EMBODIMENT

Figure 1:
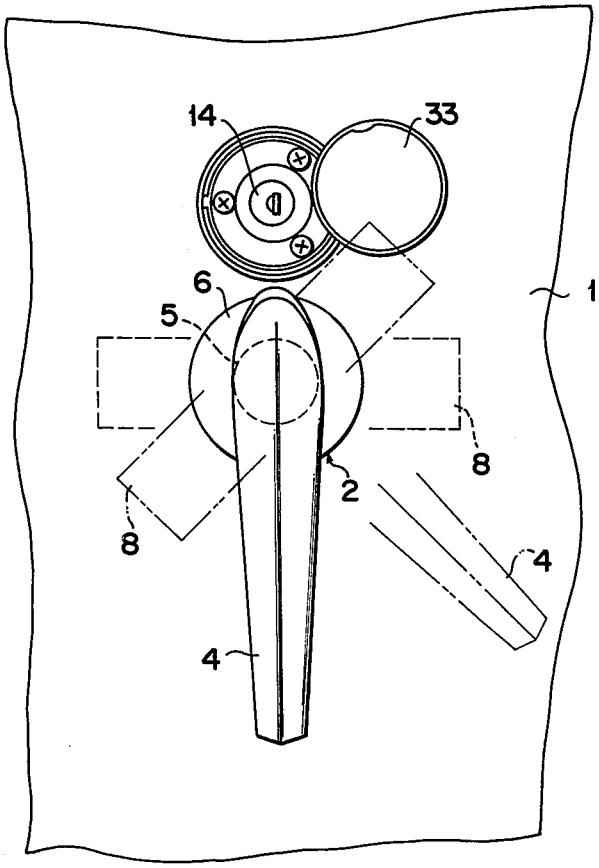
FIG. 1 is a front elevational view of a door lock in accordance with an embodiment of the invention.
Figure 2:
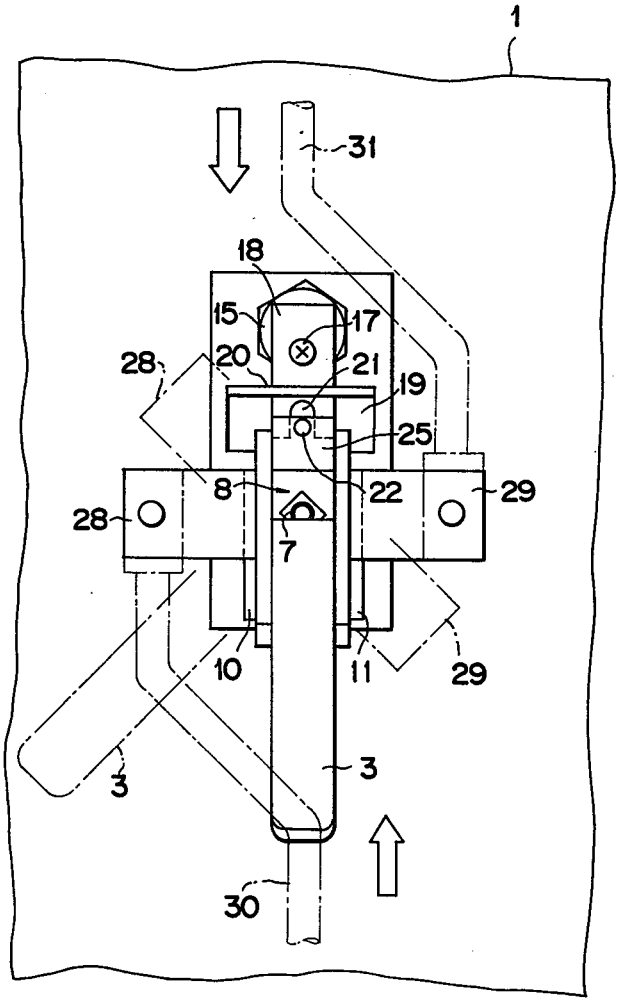
FIG. 2 is a rear elevational view of the door lock.
Figure 3:
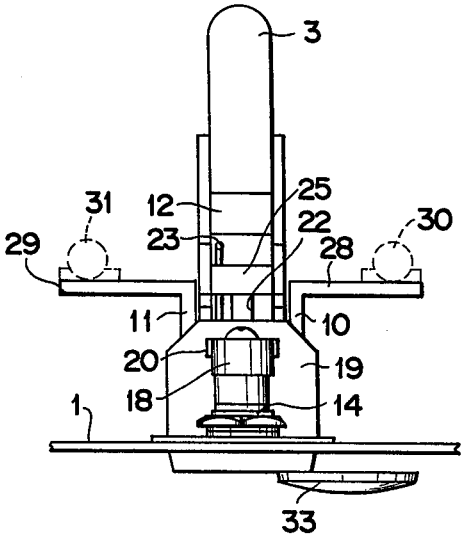
FIG. 3 is a plan view of the door lock.

As will be seen from FIGS. 1 thru 4, a handle device 2 fixed to a door panel 1 has an indoor manipulation handle 3 and an outdoor manipulation handle 4. The outdoor handle 4 has a rotatable shaft 5 which is received by bore formed in a handle support 6. A mount plate 8 non-rotatably fits around a polygonally cross-sectioned inner end 7 of the shaft 5 and fixed thereto by means of a bolt 9. The mount plate 8 has a pair of support frame plates 10 and 11 which are perpendicular to the door panel 1. The indoor handle 3 received by a space between the two support frame plates 10 and 11 is pivotally secured to these support frame plates at the end of an arm 12 projecting from the front side thereof, by means of a pivot shaft 13 extending in parallel with the plane of the panel 1. The indoor handle 3, therefore, is swingable toward and away from the door panel 1.

A lock device 14 having a lid 33, e.g. a cylinder lock, is fixed to the panel 1. The lock device 14 has an operation shaft to the inner end of which is fixed an operation disk 15 by means of a screw 16. A ltach plate 18 is pivotally secured to the operation disc 15 by means of an eccentric screw 17 and is received by a hole 20 in a guide plate 19, which is fixed to the inner surface of the door panel. Therefore, as the operation shaft is rotated by a key inserted into a key hole in the lock device 14, the latch plate 18 is moved up and down along the guide plate 19 so that a notch 21 formed at the lower end of the latch plate is brought into and out of engagement with a lug 22 formed to protrude from the upper front end surface of the indoor handle 3. A coiled spring 23 coiled around the pivot shaft 13 has one end held in contact with a spring retainer pin 24 briding the lower ends of the supporting frame plates 10 and 11 while the other end of the same is held in contact with the mounting portion 25 of the lug 22, so that the indoor handle 3 is normally biased in the counter-clockwise direction as viewed in FIG. 4.

A transverse pin 26 connected between the upper ends of the supporting frame plates 10 and 11 is adapted to be selectively engaged by a groove 27 formed in the upper side of the arm 12. When the transverse pin 26 and the groove 27 engage each other, the lug 22 on the indoor handle 3 is brought to a position where it is engageable with the noted 21 in the latch plate 18. In this state, the body of the indoor handle 3 projects obliquely. The indoor handle 3 mentioned before is provided with a pair of mounting tabs 28 and 29 at the rear side of the supporting frame plates 10 and 11. Latch rods 30 and 31, serving as means of latching the door panel 1 to a stationary part (not shown) such as stationary frame, are adapted to be connected to the mounting tabs 28 and 29, respectively. The whole parts of the indoor handle 3 and the lock device 14 including the lug 22 and the latch plate 18 are exposed on the inner surface of the door panel.

Figure 5:
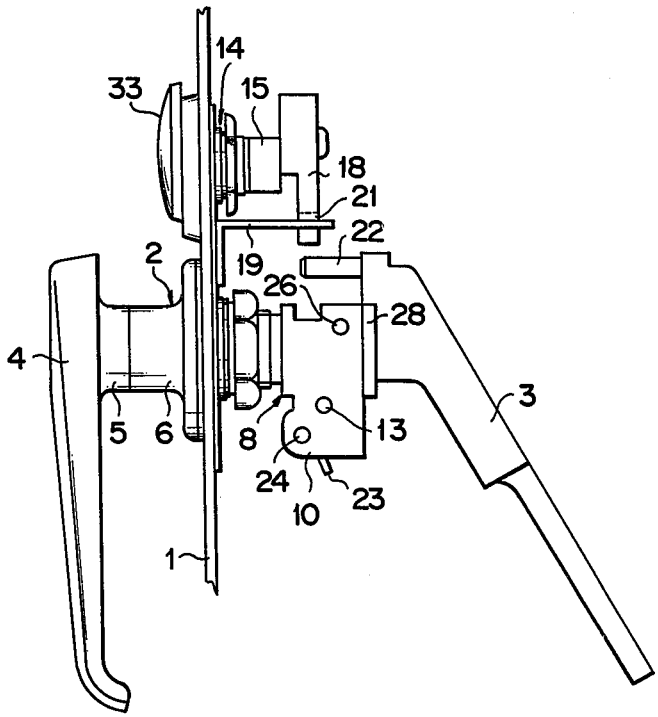
FIG. 5 is a right-side elevational view of the door lock in the state unlocked from the outdoor side.
Figure 6:
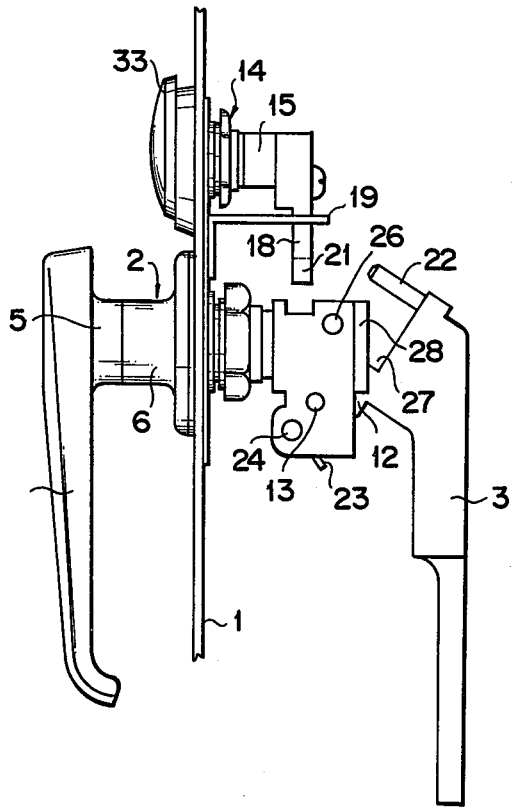
FIG. 6 is a right-side elevational view of the door lock in the state unlocked from the indoor side.

For unlocking the door lock, it suffices only to insert the key 32 into the lock device 14 and rotate the same in a predetermined direction to move the latch plate 18 up and down as viewed in FIG. 5, thereby to disengage the notch 21 in the latch plate 18 from the lug 22 on the indoor handle 3. In this state of the lock device 14, the outdoor handle 4 is rotatable together with the indoor handle 3. As the outdoor handle 4 is rotated in the predetermined direction, the mount plate 8 is rotated together with the rotary shaft 5 of the handle 4 and, therefore, the end portions of the latch rods 30 and 31 connected to the mount plate 8 are withdrawn from the rod receiving portions on the stationary part, thereby to unlock and release the door panel from the stationary part. In this state, the door panel 1 is openable by pulling the outdoor handle 4.

Figure 4:
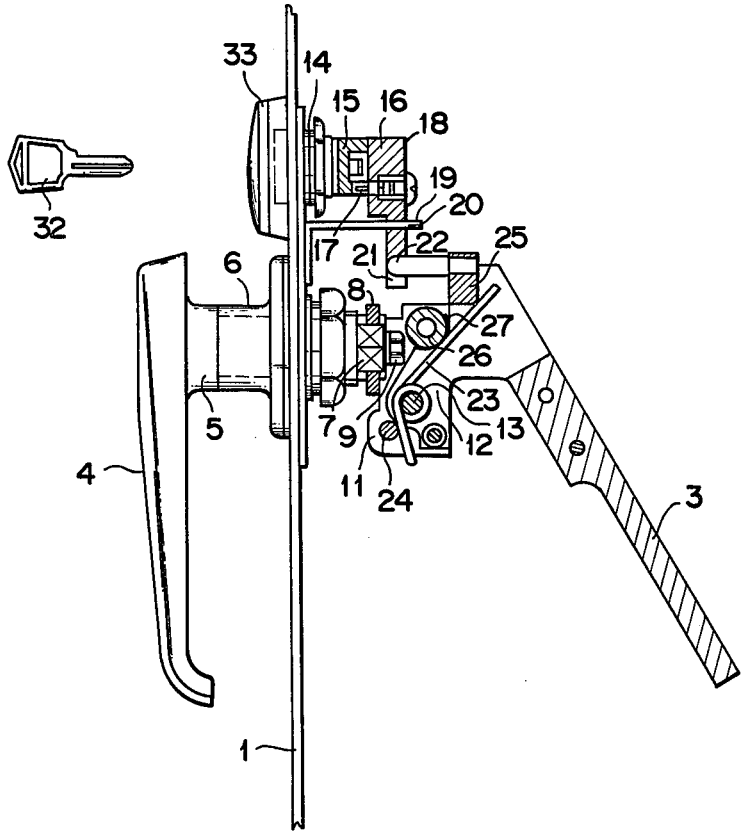
FIG. 4 is a sectional side elevational view of the door lock.

For unlocking the door lock from the indoor side, i.e. from the interior of the refrigeration chamber or the like, the indoor handle 3 is pressed towards the door panel 1 and is then rotated in the clockwise direction as viewed in FIG. 4. By so doing, even though the lock device 14 is in the locking state to keep the latch plate 18 in the lowered position where it is engageable with the lug 22, the lug 22 is rotated together with the body of the indoor handle in the above-mentioned direction to completely get out of the notch 21 in the latch plate 18. As a result, the indoor handle 3 can be rotated regardless of the state of the lock device 14, so that the worker confined in te chamber can open the door the get out of the chamber.

The door lock of the described embodiment is not exclusive and the invention can be carried out in various other forms. For instance, it is possible to provide the lug 22 on the latch plate 18 instead of on the lock device 14, while providing a cooperating receiving portion on the body of the indoor handle 3. It is also possible to use a rotatable latch plate in the lock device 14 instead of a latch plate which is movable linearly up and down as in the described embodiment. The practical constructions of the lock device 14 and the handle device 2 are not exclusive. For instance, in order that the handle device is disengaged from the lock device 14 when the indoor handle is pulled and rotated, the lock device 14 or the latch plate 18 should be disposed at the lower side of the mount plate 8. Instead of using the latch rods 30 and 31 connected to the mountplate 8, it is possible to form the mount plate 8 such that the mount plate 8 itself can make selective engagement with the receiving portion on the stationary side to serve as the latch means. It is even possible to completely separate the latch means for the door panel and the mount plate 8 from each other.

As has been described, the invention provides a door lock having a handle device 2 and a lock device 14, the handle device 2 including an indoor handle 3 and an outdoor handle 4 which are rotatable to drive and actuate the latch means for latching and unlatching the door panel 1 on the stationary frame, while the lock device 14 operable from the outer side of the door panel 1 so as to lock the indoor handle 3 and the outdoor handle 4 against rotation. The arrangement is such that the indoor handle 3 is disengaged from the lock device 14 as the indoor handle 3 is rotated by a predetermined angle, after a swinging towards or away from the door panel 1. In addition, the mechanism connecting the indoor handle 3 and the lock device 14 as a whole is exposed on the inner surface of the door panel. Therefore, anyone who has been accidentally confined in the refrigeration chamber or the like can find easily and promptly how to manipulate the indoor unlocking mechanism and, accordingly, can keep himself calm to find out the way of escape without losing self-control. Since only simple actions such as pulling or pushing and rotation of the indoor handle 3 are required for the unlocking, the manipulation can be made smoothly without substantial trouble to permit a prompt escape from the chamber.

What is claimed is:

1. A door lock unlockable from the indoor side comprising: a handle device including an indoor handle and an outdoor handle for operating a latch means for latching a door panel to a stationary frame; and a lock device adapted to be operated from the outdoor side so as to be brought into and out of engagement with said indoor handle thereby to lock said indoor handle and said outdoor handle against rotation; said indoor handle being pivotally supported to as to be able to be swung towards and away from said door panel and adapted to be disengaged from said lock device by a predetermined swinging toward or away from said door panel, the engaging structure between said indoor handle and said lock device being exposed on the inner surface of said door panel.

2. A door lock according to claim 1, wherein said lock device includes a latch plate which is moved up and down by rotation of the lock device so as to engage a lug portion of said indoor handle.

3. A door lock according to claim 1, wherein said indoor handle is normally biased by spring means in a direction away from said door panel, so that the indoor handle is disengaged from said lock device by swinging the handle toward the door panel.

4. A door lock according to claim 1, wherein said indoor handle is attached to latch means including a pair of length rods which serve to latch the door panel to said stationary frame.

* * * * *